United States Patent [19]

Patterson et al.

[11] Patent Number: 5,058,737

[45] Date of Patent: Oct. 22, 1991

[54] PLATE AND GLASS ASSEMBLY

[76] Inventors: Ronald Patterson, 11 Bd. Albert 1ER, Monte Carlo, Monaco; John W. Patterson, 20819-229th Ave. S.E., Maple Valley, Wash. 98038

[21] Appl. No.: 588,444

[22] Filed: Sep. 26, 1990

[51] Int. Cl.[5] ..... B65D 21/02

[52] U.S. Cl. ..... 206/217; 206/541; 220/23.86; 220/574

[58] Field of Search ..... 206/217, 528, 541, 542, 206/560, 564; 211/71, 74; 220/4.27, 23.83, 23.86, 574, 575; 229/904

[56] References Cited

U.S. PATENT DOCUMENTS

| | | | |
|---|---|---|---|
| D. 211,532 | 6/1968 | Ashton . | |
| 1,187,899 | 6/1916 | Gardam | 220/23.86 |
| 1,688,992 | 10/1928 | Smith . | |
| 2,240,020 | 4/1941 | Raiser . | |
| 2,565,912 | 8/1951 | Davis . | |
| 2,920,804 | 1/1960 | Minton . | |
| 3,955,672 | 5/1976 | Brundage . | |
| 4,461,396 | 7/1984 | Harper . | |
| 4,823,958 | 4/1989 | Mahmud | 220/23.83 |
| 4,867,331 | 9/1989 | Task | 220/23.83 |
| 4,927,024 | 5/1990 | Lloyd | 220/23.86 |
| 4,938,373 | 7/1990 | McKee | 220/23.86 |

*Primary Examiner*—Jimmy G. Foster
*Attorney, Agent, or Firm*—Hughes & Multer

[57] ABSTRACT

A plate assembly which allows one to carry a plate and a drinking glass in one hand. The assembly comprises a plate, a glass having an open upper end or mouth, and a mechanism for detachably fixing the upper end of the glass to the lower side of the plate with the mouth of the glass covered by the plate and the glass in an upright orientation. Both bayonet and tongue-and-groove types of securing mechanisms are disclosed as is a serving tray with a number of detachable glasses.

12 Claims, 5 Drawing Sheets

PLATE AND GLASS ASSEMBLY

TECHNICAL FIELD OF THE INVENTION

The present invention relates to plates and glasses for serving food and drink, and, more particularly, to a an assembly having a plate and a drinking glass which is attachable to the plate.

The terms "plate" and "glass" are employed herein in a broad, generic sense. The term "plate" is intended to embrace such diverse artifacts as individual eating dishes and different types of serving dishes. "Glass" encompasses both containers conventionally named by that term, beverage and soup cups, etc.

BACKGROUND OF THE INVENTION

A number of situations exist in which the use of conventional plates and glasses is difficult. For example, at parties, picnics, and other social gatherings, guests are often obligated to stand or walk about while eating and drinking. Inevitably, they are forced to hold their plate in one hand and their glass in the other. This does not leave a hand free with which to eat. The guests must first seek out resting places for their drinking glasses. Not only is this inconvenient, but the availability of such resting places is frequently quite limited at a social gathering. Furthermore, a guest may be unable to subsequently identify his drink and may recover someone else's drink by mistake. It is also frequently difficult to carry a separate plate and glass through a buffet line or when returning to one's seat at a sporting event or movie theater.

A number of plate assemblies for eliminating the need to use both hands to carry a plate and drinking glass have been proposed. One such assembly is shown in U.S. Pat. No. 2,240,020, issued Apr. 29, 1941 to Raiser. That assembly includes a plate having a central aperture in which a drinking cup can be set and a hollow handle which extends downwardly from the cup-receiving receptacle. Although this device permits one to carry both the plate and cup with one hand (using the hollow handle), the cup is not actually attached to the plate and is thus easily dislodged or overturned. Furthermore, the drink can readily slosh over the open top of the cup and onto the food. Still further, the food on the plate can easily come into contact with and foul the exterior of the drinking cup; and food may slosh through the opening in the plate and pass through the hollow handle onto an underlying table or lap.

U.S. Pat. No. 2,920,804 issued Jan. 12, 1960 to Minton discloses a somewhat similar assembly in which a hollow sleeve forms a receptacle for a drinking glass. This sleeve is joined to the plate portion by a bead which releasably engages a flange on the plate. U.S. Des. Pat. No. 211,532 issued Jun. 25, 1968 to Ashton discloses a serving tray having an overall configuration very similar to that of Minton. U.S. Pat. No. 3,955,672 issued May 11, 1976 to Brundage discloses another plate having a hole in which an open drinking cup is set. In this case, the plate has a channel for balancing the plate on the user's forearm while he grasps the lower end of the cup.

U.S. Pat. No. 4,461,396 issued Jul. 24, 1984 to Harper discloses a plate having a recess in its upper surface for the lower end of a drinking glass. The user's thumb protrudes upwardly through a hole in the plate and presses against the base of the glass to retain it in the recess. This arrangement shares disadvantages with the devices discussed above. Since the glass is not attached to the plate, momentary relief of the thumb pressure may allow the glass to become dislodged; the drink can easily slosh out of the glass and onto the food; the food can slosh through the hole in the plate; and the food contained on the plate can easily get on the outside of the glass.

U.S. Pat. No. 1,688,992 issued Oct. 23, 1928 to Smith discloses a cup and saucer combination in which the saucer may either support or cover the cup without sliding about. However, the cup and saucer are not attached to each other. U.S. Pat. No. 2,565,912 issued Aug. 28, 1951 to Davis discloses a watercolor paint set in which the palette has a center portion that rests in the mouth of a water container. As the components of these units are not attached to each other, the units have the same disadvantages as Minton's and those of similar character.

Accordingly, there exists a need for an assembly or unit in which a glass is securely attachable to a plate so that the user can safely carry the assembly in one hand and eliminate the risk that the drink contained in the glass will slosh onto food on the plate as the assembly is carried about. Furthermore, there exists a need for such a device which eliminates the risk that food on the plate will foul the exterior of the glass and for such a device which does not require holes or other openings in the plate through which food might slosh or drip.

SUMMARY OF THE INVENTION

The present invention solves the problems cited above, and comprises, broadly: (a) a plate having a generally horizontal upper surface for supporting food, a lower surface, and a peripheral rim surrounding the upper and lower surfaces; (b) at least one glass for holding a drink, the glass having an open upper end which forms a mouth; and (c) cooperating connector elements for detachably securing the mouth of the glass to the lower surface of the plate so that the mouth of the glass is covered by the plate and the glass is positioned in an upright orientation when the plate is positioned to support food.

The elements for detachably coupling the glass to the plate may include a first set of lugs on the lower surface of the plate and a second set of lugs on the upper end of the glass. These can be releasably engaged with the first set of lugs by rotating the glass relative to the plate.

In one embodiment, the first set of lugs extends outwardly from the lower end of a boss depending from the lower surface of the plate. The lugs are configured to fit in the mouth of the glass. The second set of lugs is located at the upper end of the glass, and the lugs extend radially. In another embodiment, the lugs on the glass extend radially outwardly from the upper end of the glass: and the lugs on the plate extend radially inwardly from the edge of a recess in a central portion of the lower plate surface.

Desirably, a guide channel for the upper end of the glass is so formed in the lower surface of the plate that the upper end of the glass is slideable therein. The channel extends from the rim of the plate to the central portion of the plate. The channel aligns the lugs on the plate with the lugs on the glass, facilitating the attachment of the glass to the plate.

In another embodiment, the elements for detachably securing the glass to the plate comprise a side wall portion which extends downwardly from the lower surface of the plate and defines a U-shaped, grooved channel. That channel has an open end proximate the rim of the plate and a closed end proximate the central portion of the plate. The side wall of the channel has a longitudinally extending groove formed therein. The U-shaped channel is configured to so receive the upper end of the glass that the glass is slideable in the channel from the open end to the closed end. A radial flange of the upper end of the glass is configured to fit in the groove in the channel and detachably couple the glass to the plate as the glass is slid into the channel.

In some embodiments, the assembly may include a plurality of glasses, all detachably connectable to the plate. In these embodiments, the plate may have a pedestal which positions the plate above a support surface and suspends the glasses above that surface.

The objects features, and advantages of the present invention will be apparent to the reader from the foregoing and the appended claims and as the ensuing detailed description and discussion proceeds in conjunction with the accompanying drawings.

DETAILED DESCRIPTION OF THE INVENTION

Figure 1:
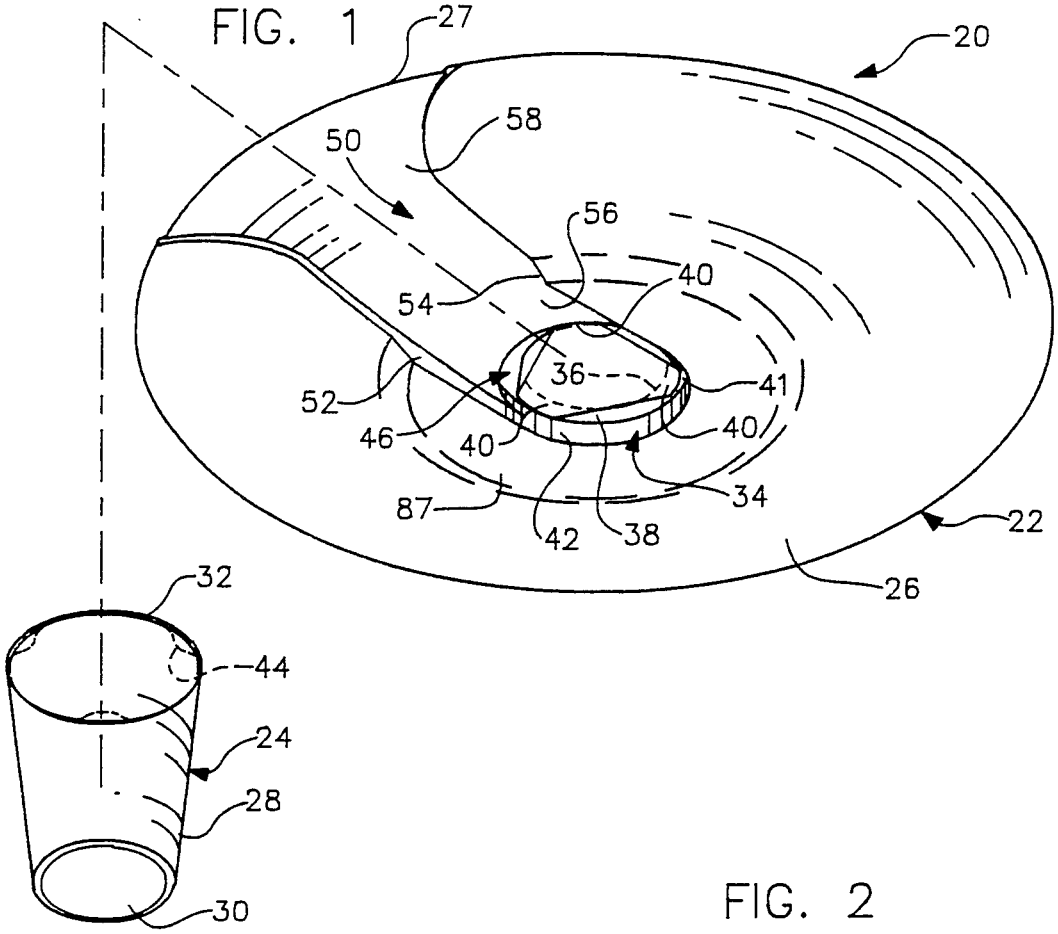
FIG. 1 is an exploded view of a plate assembly incorporating the principles of the present invention.

FIG. 1 shows a plate assembly 20 which: (a) is constructed in accord with the principles of the present invention, (b) comprises a plate 22 and a drinking glass 24, and (c) allows the plate and glass to be carried in one hand. Plate 22 has an upper surface (not shown) which is configured to support food and may be at least partially dished or concave, and a lower surface 26 which may be at least partly convex. A peripheral rim 27 surrounds the upper and lower surfaces.

Glass 24 is similar to a conventional drinking glass. It has a tapered side wall 28, a closed bottom 30, and an open top end 32 which forms a mouth for drinking or pouring liquid from glass 24.

Plate 22 and glass 24 may be fabricated of any suitable material, including, for example, vacuum-formed plastic, injection molded plastic, ceramic, glass, metal, wood, paper, or the like. In view of the particular advantages enjoyed by the plate assembly of the present invention for use in social events, it may be particularly desirable to fabricate the plate assembly of a material having a low cost so that the plate assembly is disposable.

A circular recess 34 is formed in a central portion of the lower surface 26 of plate 22. A central boss, indicated by broken line 36, is positioned coaxially in circular recess 34. The boss extends downwardly from the top wall 38 of receptacle 34. Three lugs 40 of a bayonet-type connector on the lower end of boss 36 extend radially outwardly therefrom and define vertical gaps between the upper sides of lugs 40 and the upper surface 38 of recess 34. Lugs 40 also define gaps 41 intermediate their outer ends and the wall 42 of recess 34. Recess 34 is sized to receive the upper end 32 of glass 24, and the gaps 41 intermediate the ends of lugs 40 and wall 42 are sized to permit passage therethrough of the relatively thin side wall 28 of glass 24.

The upper end 32 of glass 24 has three complementary lugs 44 which extend radially into the mouth of the glass. Lugs 44 are sized to pass upwardly into recess receptacle 34 through the openings 46 intermediate boss 36 and side wall 42. However, lugs 44 are sufficiently large to prevent their passage through the gaps 41 between the outer ends of lugs 40 and side wall 42.

To attach glass 24 to plate 22 so that the plate and glass can be carried in one hand, the upper end 32 of the glass is positioned in recess 34. The user then grips side wall 28 of glass 24 and rotates the glass relative to plate 22 in the direction indicated by arrows 48. This positions lugs 44 above lugs 40 in the gaps bet ween lugs 40 and top wall 38 so that glass 24 is firmly attached to plate 22 and the user can freely move about without fear of dislodging the glass. Also, the abutment of upper end 32 of glass 24 against top wall 38 of recess 34 minimizes spillage of liquid in the glass, even if it is tipped over or sloshed about.

One or both sets of lugs 40 and 44 may also be provided with sloped engagement surfaces so that the upper end of the glass is tightened and sealed against plate 22 as the glass is rotated to engage the lugs.

To remove glass 24 from plate 22, the user simply rotates glass 24 until lugs 44 are positioned in openings 46 and then removes glass 24 from the bottom of plate 22.

Lower surface 26 of plate 22 is preferably further provided with a channel 50 for guiding the upper end 32 of glass 24 into recess 34 and thereby facilitating the glass-attaching engagement of lugs 40 and 44. Channel 50 is defined by: (a) first and second side walls 52 and 54, which extend downwardly from lower surface 26 of plate 22 and (b) a generally planar top wall 56, which connects side walls 52, 54. Channel 50 is generally U-shaped and opens onto recess 34 at its inner ends. The channel has an open end which is proximate the rim 27 of plate 22. Over the major portion of channel 50, first and second side walls 52 and 54 are parallel to one another and define a channel slightly wider than the external diameter of the top end 32 of glass 24. This permits glass 24 to be received in and slide along channel 50. At the open end of channel 50, near rim 27, side walls 52 and 54 diverge which makes it easier for the user to insert the upper end of the glass into the channel.

The bottom of plate 22 aligns the upper end of the glass in a vertical direction with the opening of recess 34. To insert the upper end 32 of glass 24 in that recess, the user positions glass 24 with its upper end is generally in horizontal alignment with plate 22, and generally in radial alignment with the open end of channel 50. He then moves the glass along the channel toward the center of the plate 56 until it is vertically aligned with recess 34. The user then displaces the upper end 32 of glass 24 into the recess and rotates the glass to engage the plate-and-glass associated lugs 40 and 44.

Figure 2:
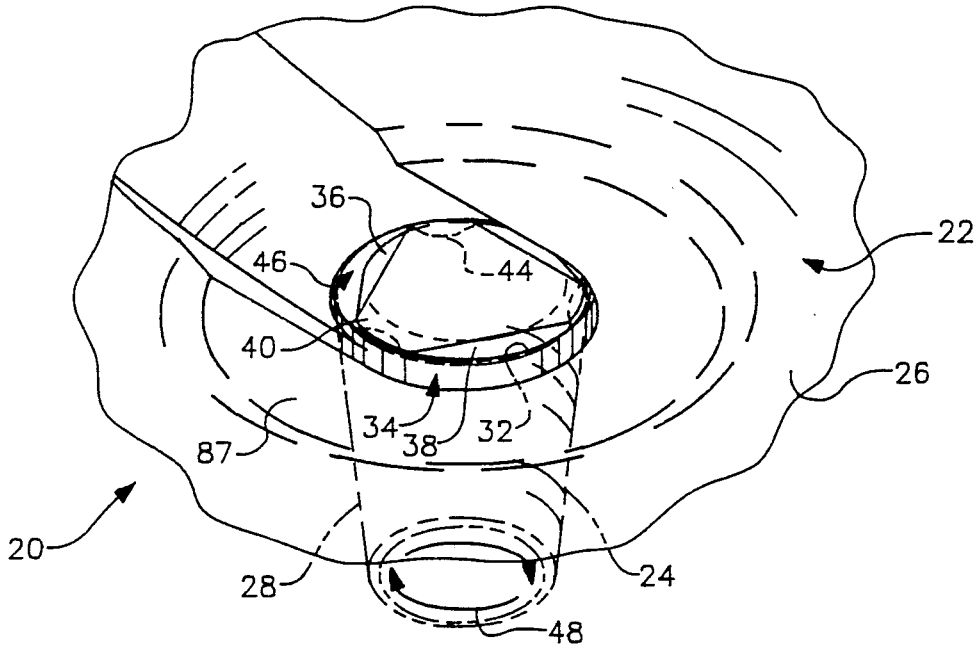
FIG. 2 is a fragmentary enlarged view of the assembly with the glass attached to the plate.
Figure 3:
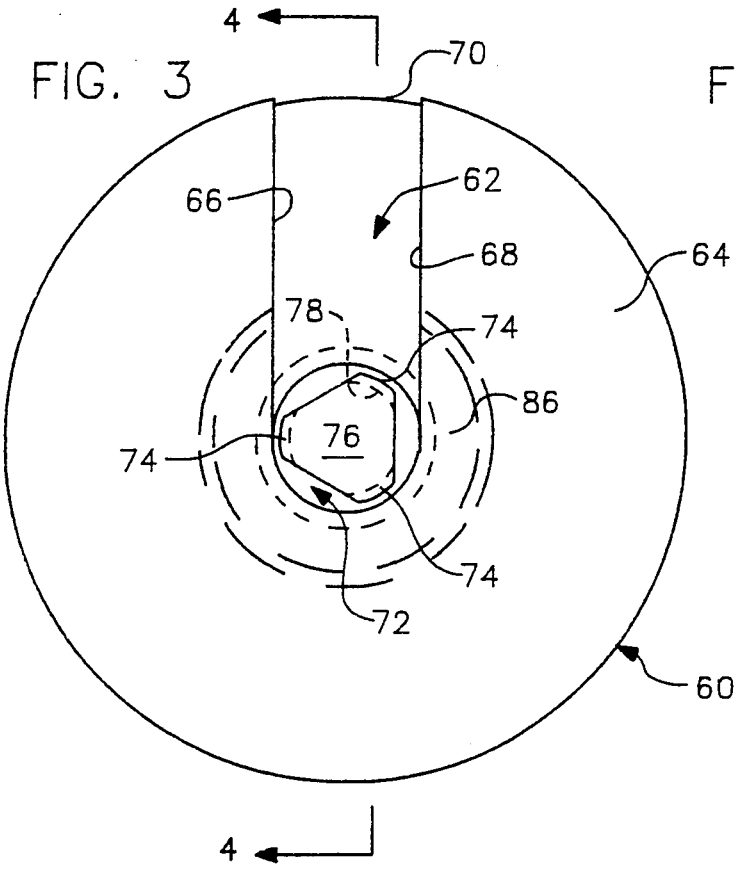
FIG. 3 is a bottom view of a plate employed in another plate assembly incorporating the principles of the present invention.

FIG. 3 shows a second plate 60 for use in plate assemblies according to the present invention. Plate 60 is generally identical to the plate 22 shown in FIGS. 1–2 except that the channel 62 in the lower surface 64 of plate 60 has side walls 66 and 68 which are generally parallel along their entire length from rim 70 to central recess 72. Like plate 22, plate 60 has three plate-mounted lugs 74. These lugs constitute a triangular lug assembly 76 on the lower end of central boss 78, and they extend laterally beyond the outer edge of boss 78.

Figure 4:
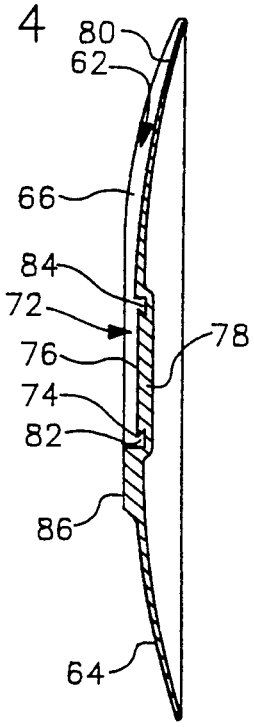
FIG. 4 is a sectional view of the plate of FIG. 3, taken along line 4—4 of FIG. 3.

As is shown in FIG. 4, the lug assembly 76 at the lower end of boss 78 is recessed into the lower surface 64 of plate 60 like the lower end of the boss 36 shown in FIGS. 1–2. However, the lower end of boss 78 may equally well be substantially coplanar with the top wall of the plate's glass guiding channel. As the upper end of the glass is slid along channel 62 from the rim 70 of the plate to central recess 72 in a plate with this type of boss, the upper end of the glass can freely slide past the lower end of boss 78 as it reaches recess 72, thereby facilitating the positioning of the glass in the recess.

The upper sides of lugs 74 may be beveled outwardly towards their ends at an angle of 45°. In this case complementary bevels are provided on the lugs at the upper end of the glass. This is a particularly economical and efficient arrangement for achieving the desired overlapping and locking of the lugs, and the relatively thick base of each lug provides it with additional strength and durability.

As is shown both in FIGS. 3 and 4, an annular shoulder 86 is formed in the lower surface 64 of plate 60 and around the major portion of the perimeter of recess 72. Shoulder 86 steadies plate 60 and keeps it from tipping when it is placed on a table or other flat surface without a glass. Because it is narrow, channel 62 does not interfere to any significant extent with this function of shoulder 86.

Figure 5:
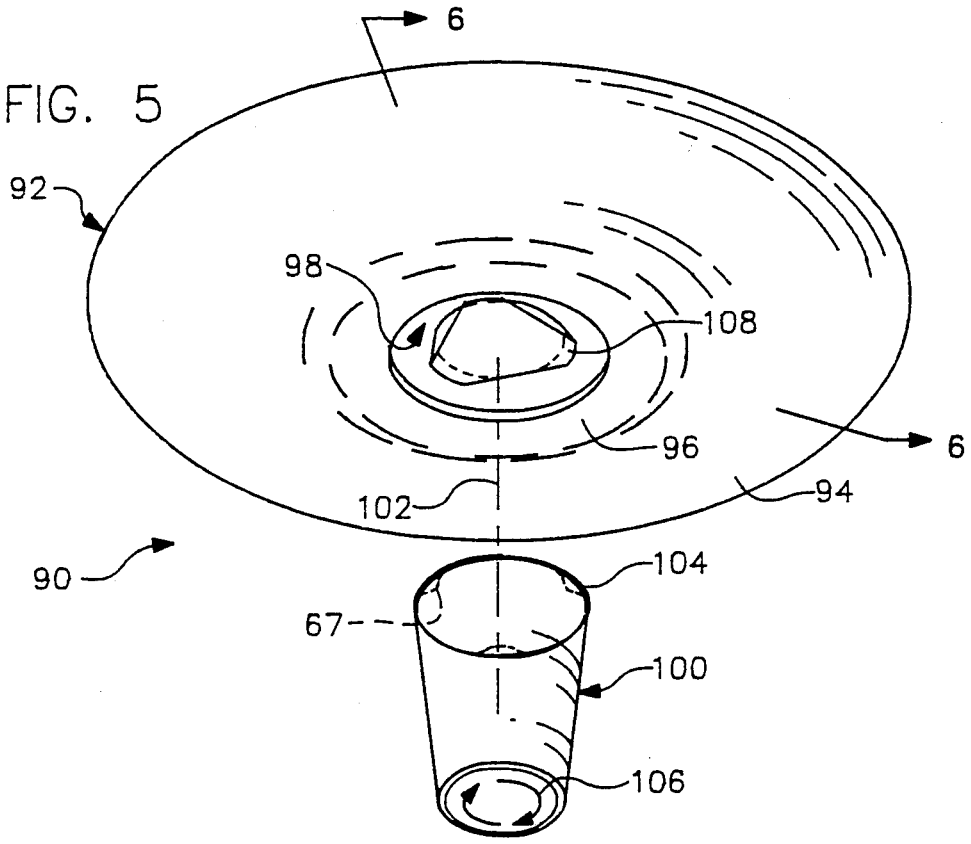
FIG. 5 is an exploded view of a third plate assembly incorporating the principles of the present invention.

FIG. 5 shows a plate assembly 90 which is similar to the Plate assemblies shown in FIGS. 1–4 except that the channel for guiding the glass into interlockable relationship with the plate is absent. In this embodiment, the user: (1) moves glass 100 upwardly against plate 92, (2) displaces the glass along axis 102, (3) inserts the upper end 104 of glass 100 in recess 98, and (4) rotates glass 100 relative to plate 92 in the direction indicated by arrows 106 to engage the lugs 107 on the glass with the lugs 108 on the plate and thus detachably connect the plate and glass together.

Plate assembly 90 has several advantages aside from those common to previously described embodiments of the invention. For example, liquid contained in glass 100 will stay warm longer as the mouth of glass 100 is covered by the lower surface 94 of plate 92 and prevents the escape of heat from the glass.

Figure 6:
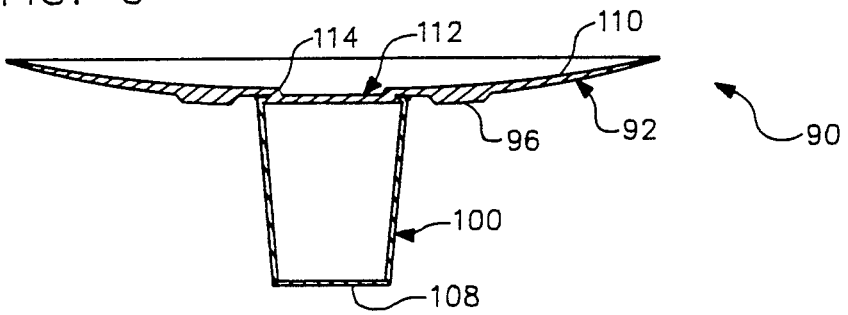
FIG. 6 is a sectional view of the plate assembly of FIG. 5 with a glass attached to the plate of the assembly)y.

As is best shown in FIG. 6, the plate 92 of assembly 90 has an upper surface 110 in which a circular central recess 112 is formed. Recess 112 is configured to receive the circular bottom 108 of a second glass 100 so that a plurality of plate assemblies 90 can be stacked on top of one another. A shoulder 114 around recess 112 prevents the bottom 108 of each glass 100 from sliding on the upper surface of the plate, thereby stabilizing the stack of plate assemblies.

Figure 7:
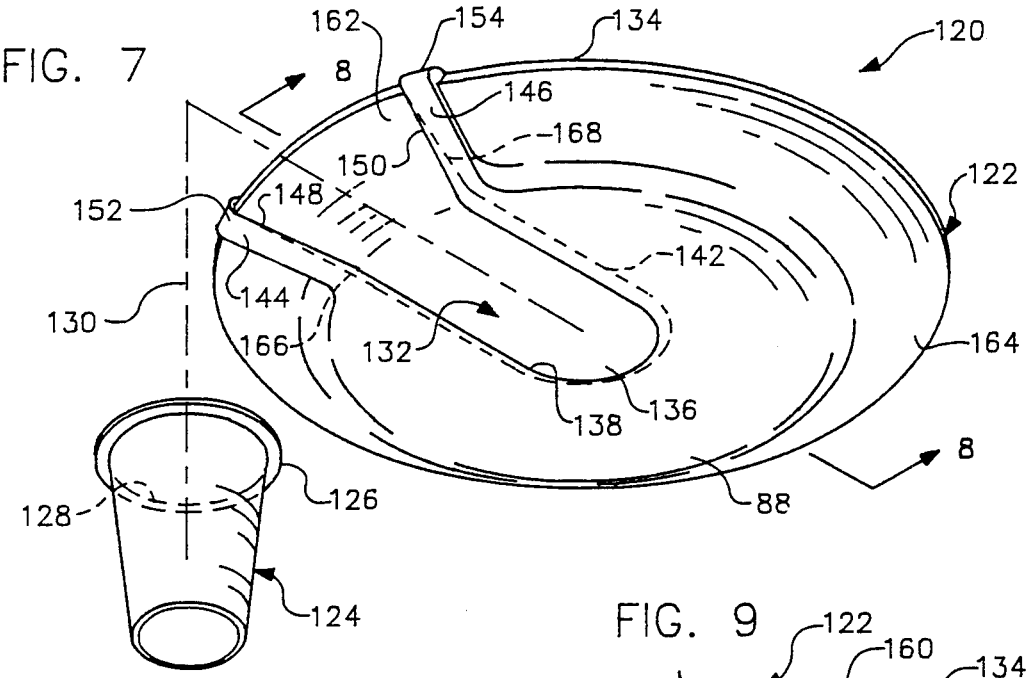
FIG. 7 is an exploded view of another embodiment of plate assembly incorporating the principles o the present invention; in this embodiment a grooved channel on the lower side of the plate and a flanged upper end of a glass are used to attach the glass to the plate.

Turning now to FIG. 7, a flange and groove arrangement as employed in the illustrated plate assembly 120 can also be used to detachably connect a plate and glass together. Plate assembly 120 comprises a plate 122 and a glass 124. Glass 124 has a circumferential, outwardly extending, radial flange 126 at its open upper end 128. Plate 122 has a locking channel 132 which, (1) is defined by a side wall 138, (2) is generally U-shaped, (3) and has an open end at rim 134 of plate 122 and a closed end at the center 136 of the plate. Channel 132 is slightly wider than the external diameter of glass 124 at the upper end 128 thereof. Side wall 138 has a longitudinal groove, indicated by broken line 142, which extends laterally into side wall 138 from channel 132 and is configured to slidingly receive flange 126.

In the embodiment illustrated in FIG. 7, channel 132 has a pair of ribs 144 and 146 proximate its open end for guiding glass 124 into the channel. Ribs 144 and 146 are flared so that the lateral gap between inner rib edges 148 and 150 is wider near the rim 134 of plate 122 than where edges 148 and 150 meet the parallel portions of side wall 138. Glass 124 can accordingly be started toward the center of plate 122 without concern about its exact location relative to channel 132. Thereafter, ribs 144 and 146 guide the glass into channel 132 as the displacement of the glass toward the center of plate 122 is continued.

The tablike outer ends 152 and 154 of locating ribs 144 and 146 are integrated with the rim 134 of plate 122. Tab portions 158 eliminate breakage of the ribs when plate 122 and glass 124 are connected together.

To attach glass 124 to plate 122, the user displaces glass 124 along vertical axis 130 (see FIG. 7) until the upper end 128 of glass 124 is: (1) horizontally aligned with the downwardly sloped portion 162 of the lower surface 164 of the plate, and (2) radially aligned with the open end of locking channel 132. The user then moves glass 124 toward center portion 136 of the plate. In the course of this movement, the upper end 128 of glass 124 is guided by the downwardly sloping portion 162 of the lower plate surface and locating ribs 144 and 146 into the groove 142 which secures glass 124 to plate 122.

To further facilitate the initial alignment of glass 124 with plate 122, guide ribs 144 and 146 may also have starting grooves 166 and 168 leading into groove 142.

Figure 8:
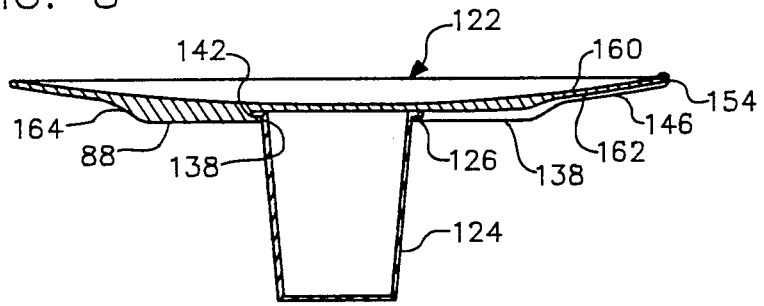
FIG. 8 is a sectional view of the Plate assembly, taken along line 8—8 of FIG. 7 with the glass attached to the plate.

Once flange 126 is started in groove 142, the user continues to move glass 124 inwardly until it reaches central Portion 136. At this juncture, the major portion of flange 126 is engaged and supported by groove 142 because the semicircular closed end of U-shaped channel 132 is configured to complement the upper end of the glass. Glass 124 is thus securely attached to plate 122 in an upright position, as shown in FIG. 8, and with its mouth covered by the lower surface of the plate. The user can reverse the above-described process and slide glass 124 out of the open end of channel 132 to detach glass 124 from plate 122.

Figure 9:
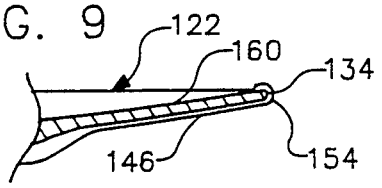
FIG. 9 is a section through the outer edge of the plate of FIGS. 7 and 8, showing an attachment of the member in which the grooved channel is formed to the rim of the plate.

The construction shown in FIGS. 7–9 is eminently suitable for plates and glasses which are relatively thick-walled such as ceramic or injection-molded plastic plates and glasses.

Figure 10:
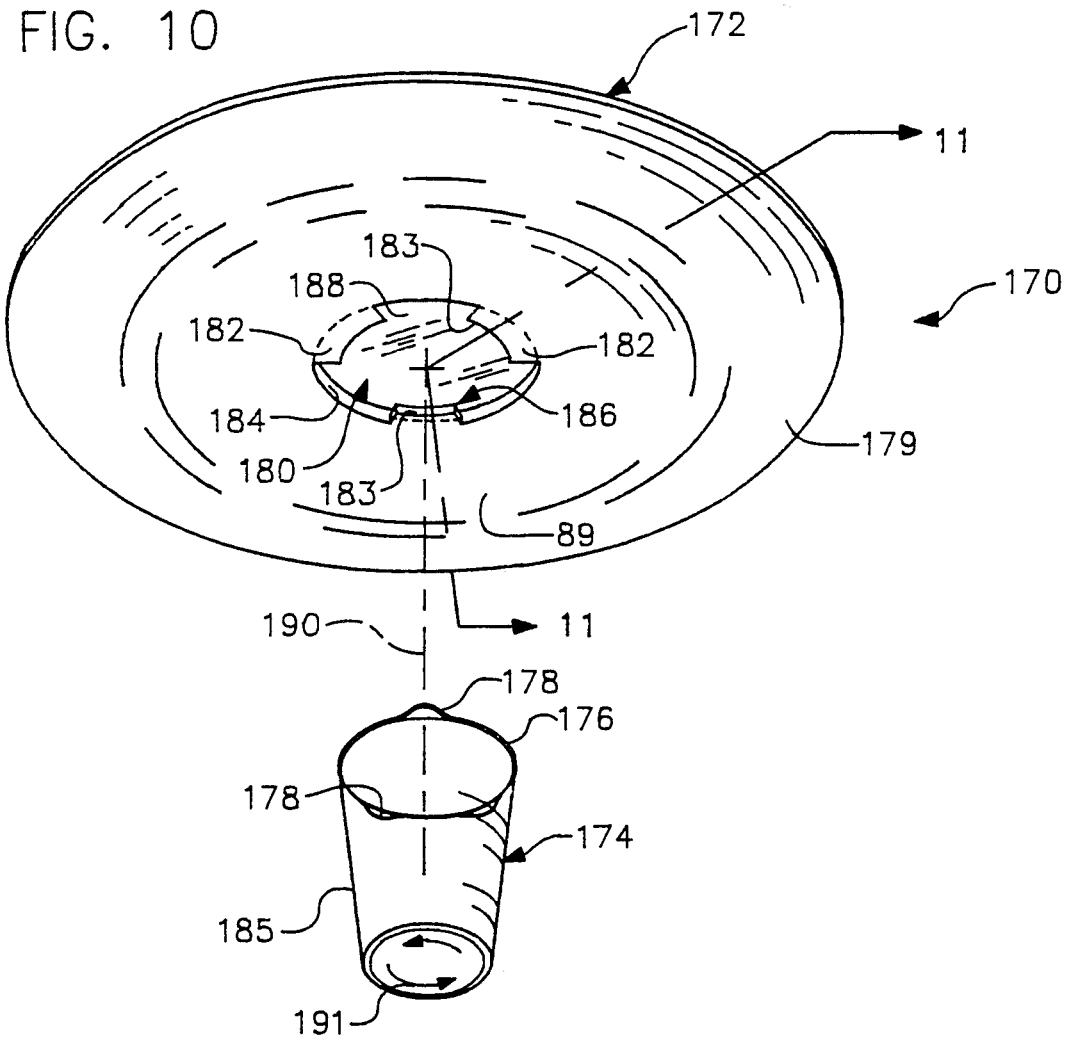
FIG. 10 is a perspective view of another plate assembly incorporating the principles of the present invention and having a plate with inwardly projecting lugs and a glass with outwardly projecting lugs for engaging the lugs on the plate and thereby securing the glass to the plate.

FIG. 10 shows a plate 170 employing the principles of the present invention which is like the FIGS. 5–6 embodiment except for the lugs on the plate and glass. Plate assembly 170 comprises a plate 172 and a glass 174. The open upper end 176 of glass 174 has three lugs 178 which extend radially outward from the mouth of the glass. The central portion of the lower surface 179 of plate 172 has a recess 180 Which is sized to receive the upper end 176 of glass 174. Three cooperating plate associated lugs 182 extend radially inwardly from the outer wall 184 of recess 180. Thus, when the upper end of the glass is positioned in recess 180, the inner ends 183 of lugs 182 are proximate the side wall 185 of glass 174; and the lugs 178 on glass 174 project outwardly from the glass beyond the inner ends 183 of lugs 182.

Vertical plate-associated lugs 182 are Positioned Proximate the lower end of recess 180 and bound gaps 186 between the upper portions of lugs 182 and the top wall 188 of recess 180. These gaps receive the outwardly extending lugs on glass 174 when the top end 176 of the glass is abutted with top wall 188. As in other embodiments of the invention, these gaps may be formed by bevelling the upper surfaces of lugs 182.

Figure 11:
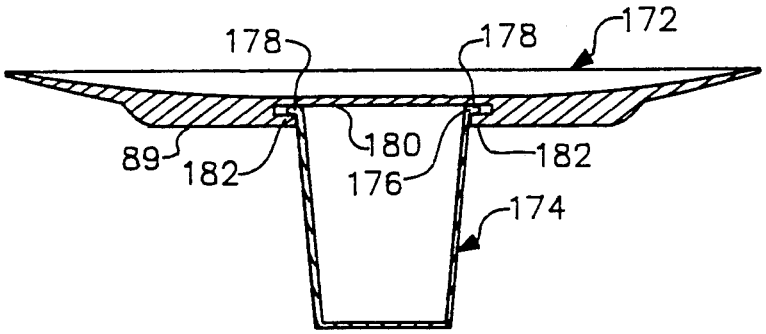
FIG. 11 is a sectional view of the plate assembly of FIG. 10; this section is taken along line 11—11 of FIG. 10 and shows how the glass is attached to the bottom of the plate.

To attach glass 174 to plate 172, the user raises glass 174 relative to plate 172 along axis 190 (FIG. 10) and inserts the upper end 176 of glass 174 into recess 180. Each lug 178 on glass 174 passes between a pair of lugs 182 on plate 172 so that the upper end of the glass comes into abutment with the top Wall 188 of the recess. The user then rotates glass 174 relative to plate 172 about axis 190 in the direction indicated by arrows 191 until lugs 178 are positioned in gaps 186 above lugs 192 as shown in FIG. 11. At this point, glass 174 is securely, but detachably, secured to plate 172 with its mouth covered by the lower surface of the plate. This gives the assembly the same advantages that previously described embodiments of the invention have.

Figure 12:
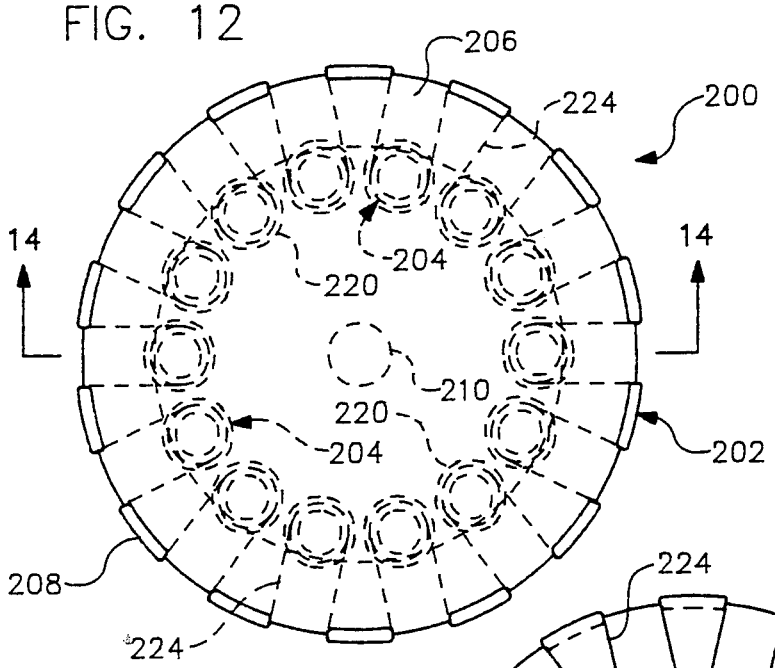
FIG. 12 is a top view of still another embodiment incorporating the principles of the present invention; in this embodiment a plurality of glasses can be attached to the plate of the assembly.
Figure 13:
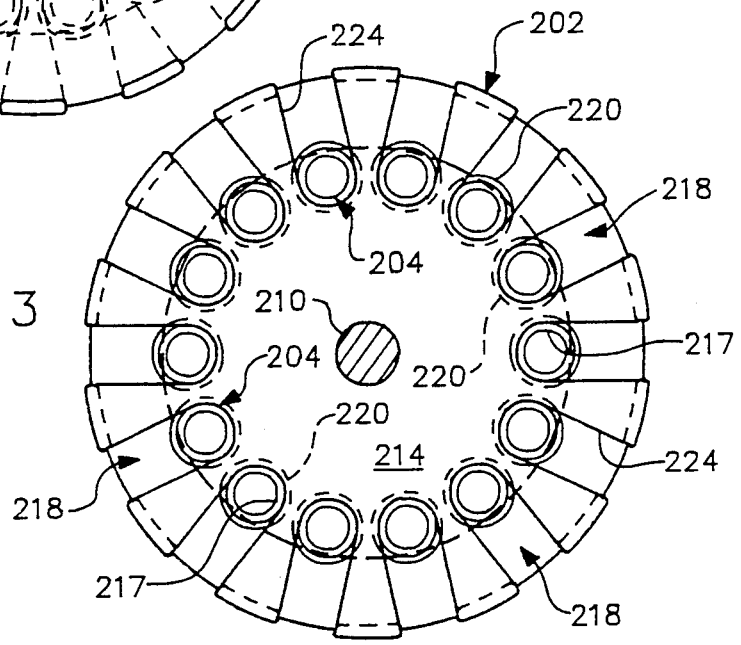
FIG. 13 is a bottom view of the assembly of FIG. 12.
Figure 14:
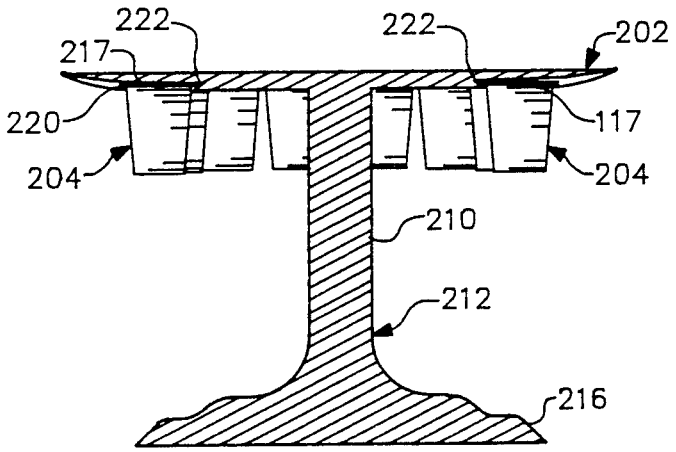
FIG. 14 is a sectional view of the plate assembly of FIGS. 12–13, taken along line 14—14 of FIG. 12.

FIGS. 12–14 show yet another plate assembly 200 incorporating the principles of the present invention. This assembly is eminently suitable for serving individual portions of food such as cookies and bors d'oeuvres.

Assembly 200 has a pedestalled plate 202 to which a number of glasses 204 can be detachably coupled. Plate 202 has a relatively large upper surface 206 for supporting comestibles, and a peripheral rim 208. The column portion 210 of a pedestal 212 (see FIG. 14) is integrated with plate 202 at the center of the lower surface 214. Column 210 extends downwardly and terminates in a base portion 216 which is configured to rest on a table top or other support surface.

Pedestal 212 elevates plate 202 above a table top or other support surface with glasses 204 suspended beneath plate 202 and conveniently accessible by the guests.

The glasses 204 are fixed to the under side of plate 202 in a radial array about the column 210 of pedestal 212. Any of the mounting arrangements described above may be employed for this purpose. In the embodiment shown in FIGS. 12–14, the lower surface 214 of plate 202 has a plurality of U-shaped channels 218, similar to the U-shaped channel 132 described above with reference to FIGS. 7–8. Channels 218 are arranged radially about the axis of plate 202; they have open ends at the rim 208 of plate 202 and closed ends toward the center of plate 202. The open upper end 217 of each glass 204 has a radially extending flange 220 which is received in a complementary groove 222 (see FIG. 14) formed in the side wall 224 of each U-shaped channel 218. Accordingly, when the upper ends of the glasses are displaced to the closed ends of the U-shaped channels, the glasses are held upright with their mouths covered by the lower surface 217 of plate 202. This both reduces the risk of spillage when the plate assembly is handled and helps to keep liquid in the glasses 204.

Each guest may also be given an individual plate with a corresponding mounting arrangement so that a glass 204 can be conveniently carried about after the guest has removed it from plate 202.

Several embodiments of the present invention have been described in detail above.

The invention may be embodied in still other specific forms without departing from the spirit or essential characteristics thereof. The present embodiments are therefore to be considered in all respects as illustrative and not restrictive, the scope of the invention being indicated by the appended claims rather than by the foregoing description. All changes which come within the meaning and range of equivalency of the claims are therefore intended to be embraced therein.

What is claimed is:

1. A plate assembly comprising:

a plate having a generally horizontal upper surface for food and a lower side, said assembly having a longitudinal axis normal to said upper surface;

at least one glass for holding a liquid, said glass having an open upper end which forms a mouth, and said glass and plate having complementary components; and means allowing relative displacement of the plate and the glass in a plane normal to the longitudinal axis of the assembly and means responsive to said relative displacement for interengaging complementary components of said glass and said plate and thereby so detachably connecting said upper end of said glass to the lower side of said plate that said mouth of said glass is covered by said plate and said glass is positioned in an upright orientation when said plate is horizontally positioned.

2. A plate assembly comprising:

a plate having a generally horizontal upper surface for food and a lower side;

at least one glass for holding a liquid, said glass having an open upper end which forms a mouth; and means for so detachably connecting said upper end of said glass to the lower side of said plate that said mouth of said glass is positioned in an upright orientation when said plate is horizontally positioned, the means for detachably connecting said glass to said plate comprising:

first lug means on the lower side of said plate; and second, complementary lug means on said upper end of said glass, said second lug means being releasably engageable with said first lug means in response to manual rotation of said glass relative to said plate.

3. The plate assembly of claim 2, wherein said first lug means comprises:

a boss on the lower side of said plate, said above having a lower end spaced from said lower side of said plate;

a plurality of lugs at said lower end of said boss and extending radially outward from said boss;

the lugs on said boss being configured to fit in said mouth of said glass; and said second lug means comprising a plurality of lugs at said upper end of said glass and extending radially into said mouth of said glass, the lugs of said plate being so configured that the lugs of said glass are positionable above the lugs of said plate to hold the glass to the plate by positioning the lugs of the said plate in said mouth of said glass and rotating said glass relative to said plate.

4. The plate assembly of claim 3, further comprising guide means for aligning said first lug means of said plate with said second lug means of said glass.

5. The plate assembly of claim 4, wherein said first lug means is located in a central portion of said plate; and said guide means comprises a channel formed in the lower side of said plate for slidably receiving said upper end of said glass, said channel extending from the periphery of said plate to the central portion of said plate.

6. The plate assembly of claim 5, wherein said channel comprises:

first and second side walls which extend downwardly from said lower side of said plate, said side walls being laterally spaced apart to permit said upper end of said glass to be received between said side walls; and a top wall extending between said first and second side walls and defined by the lower side of the plate.

7. The plate assembly of claim 6, wherein said boss is located in a recess on the lower side of said plate at said second end of said channel, said recess being configured to receive said upper end of said glass and said lower end of said boss being recessed above said top wall of said channel at said second end of said channel so that said upper end of said glass is freely slideable past said lower end of said boss as said glass is displaced from said first end of said channel to said second end of said channel.

8. The plate assembly of claim 7, wherein said first and second side walls of said channel diverge at the periphery of the plate and thereby assist one in deploying said upper end of said glass in said channel.

9. The assembly of claim 6 wherein said connecting means has the capability of suspending said glasses in a radial array on the lower side of said plate.

10. The plate assembly of claim 2, wherein:

said second lug means comprises a plurality of lugs extending outwardly from said upper end of said glass;

said first lug means comprises a recessed central portion of said lower side of said late for receiving said upper end of said glass and a plurality of lugs extending radially inwardly from the edge of said recess; and said lugs of said glass and said lugs of said plate so configured that said lugs of said glass are positionable above said lugs of said plate to attach said glass to said plate by positioning said upper end of said glass in said recess nd then rotating said glass relative to said plate.

11. A plate assembly comprising:

a plate having a generally horizontal upper surface for food and a lower side;

at least one glass for holding a liquid, said glass having an open upper end which forms a mouth; and means for so detachably connecting said upper end of said glass to the lower side of said plate that said mouth of said glass is covered by said plate and said glass is positioned in an upright orientation when said plate is horizontally positioned;

the means for detachably connecting said glass to said plate comprising:

means extending downwardly from said lower side of said plate and defining a U-shaped channel having an open end at the periphery of said plate and a closed end proximate a central portion of said plate, said U-shaped channel being configured to slidably receive said upper end of said glass from said open end of said channel to said closed end of said channel and said channel defining means having a longitudinally extending groove formed therein; and a radial flange extending outwardly from said upper and of said glass, said flange being configured to fit in said groove to detachably connect said glass to said plate as a result of positioning said flange in said groove at said open end of said channel and then sliding said flange in said groove to said closed end of said channel.

12. A plate assembly comprising:

a plate having a generally horizontal upper surface for food and a lower side;

a plurality of glasses for holding a liquid, each of said glasses having an open upper end which forms a mouth;

means for so detachably connecting the upper end of each said glass to the lower side of said plate that the mouth of the glass is covered by said plate and the glass is positioned in an upright orientation when said plate is horizontally positioned; and a pedestal for so supporting said plate above a surface that said glasses are suspended above said surface.

* * * * *